United States Patent [19]

Dismukes

[11] 4,436,168

[45] Mar. 13, 1984

[54] THRUST GENERATOR FOR BORING TOOLS

[76] Inventor: Newton B. Dismukes, 2952 Buttonwood Dr., Carrollton, Tex. 75006

[21] Appl. No.: 339,001

[22] Filed: Jan. 12, 1982

[51] Int. Cl.[3] ..... E21B 4/04

[52] U.S. Cl. ..... 175/94; 175/107; 175/104; 175/61; 173/163

[58] Field of Search ..... 175/62, 65, 67, 94, 175/101, 102, 104, 105, 106, 107; 173/163, DIG. 1

[56] References Cited

U.S. PATENT DOCUMENTS

| | | | |
|---|---|---|---|
| 2,251,916 | 8/1941 | Cross | 175/284 |
| 3,181,631 | 5/1965 | Nielsen | 175/104 |
| 3,389,758 | 6/1968 | Bühler | 175/104 |
| 3,873,156 | 3/1975 | Jacoby | 299/17 |
| 4,031,971 | 6/1977 | Miller | 175/67 |

*Primary Examiner*—William F. Pate, III
*Assistant Examiner*—William P. Neuder
*Attorney, Agent, or Firm*—Sidney A. Johnson

[57] ABSTRACT

The present invention provides an electrically powered system for advancing a rotary boring tool in situations where the inclination of the bore hole is such that the force of gravity does not provide sufficient forward thrust. One or more marine screw propellers are rotated by the motor which itself is restrained from rotation by being fixedly connected to a flexible, twist resistant conduit for conducting the drilling fluid and electric power from the surface. The system may also provide for different rotative speeds for propeller and bit and for counter-rotating propellers to minimize torque forces on the conduit.

15 Claims, 5 Drawing Figures

THRUST GENERATOR FOR BORING TOOLS

RELATED APPLICATIONS

This application is related to my application Ser. No. 207,798 filed Nov. 17, 1980 entitled "ROTARY EARTH BORING TOOL" which application is directed to the provision of a system utilizing power derived from the circulating drilling fluid for providing forward thrust for a boring tool.

BACKGROUND OF THE INVENTION

1. Field of the Invention

The present invention also relates to the provision of a system, preferably electrically powered, for providing forward thrust for a fluid immersed boring tool. More particularly, the invention provides the necessary thrust, a dynamic force, for the operation of a rotary boring tool in situations, such as the drilling of generally horizontal bore holes, where the force of gravity does not act to provide effective forward thrust. The invention is especially efficaceous with flexible drill pipe or conduit such as may be used in drilling bore holes having a small radius of curvature.

2. Description of the Prior Art

Hydraulic power has been used to rotate boring tools in drilling vertical and deviating bore holes for many years. Typical of such tools is the Dyna-Drill, offered by the Dyna-Drill Company, a division of Smith International, Inc. of Irvine, California. The power generated by the Dyna-Drill is used, and only used, to rotate the drilling bit. The system is used with conventional drill pipe and drill collars to provide the desired weight on bit or thrust.

A. McDougall, U.S. Pat. No. 469,841 discloses a system for dredging in which a boring tool is mounted on the same shaft as a propeller. Flow of liquid circulated for the dredging operation causes both to rotate. Thrust for the boring tool, however, is obtained by the weight of the system. The reverse circulation system disclosed actually tends to lift McDougall's boring tool rather than to advance it.

A water jet propelled nozzle head for cleaning pipes and conduits is disclosed by U.S. Pat. No. 2,710,980 to Pletcher in which jets direct water against vanes to rotate an outer section relative to an inner section which is fixedly secured to a hose. Neither the rotative nor the advancing force developed is adequate for subsurface earth boring.

More generally, the prior art is rich in the field of drilling directionally deviated wells using rotary bits turned either from the surface or by subsurface mud turbines.

Roy Cross in U.S. Pat. No. 2,251,916 discloses a system for solution mining of salts occurring in thin layers where forced circulation of the solvent is necessary to effectively contact and dissolve the material to be mined. Generally, he discloses the use of horizontally directed nozzles to direct a stream of fresh solvent, specifically water, against the face of the material to be mined, specifically potash salts. In one form of his invention, shown in his FIG. 5, Cross schematically shows an electrically driven device which purportedly will produce horizontal circulation and at the same time cut away residue salts not dissolved by the solvent. Rotation of an electric motor shaft is supposed to rotate a drill bit on one end thereof and a propeller generating forward thrust on the other end. Since the motor housing is freely suspended and has no resistance to twisting, as soon as any torque is imposed on the shaft by the propeller or the drill bit, the housing rather than the shaft would rotate. Thus, the device shown is inoperative.

SUMMARY OF THE INVENTION

The instant invention utilizes the principles of a marine screw propeller to derive thrust forces for the operation of an earth boring tool. The marine screw propeller is normally used to develop the thrust needed to move a vessel through water. According to "Principles of Naval Architecture", Vol. II, edited by Rossell and Chapman, and published by the Society of Naval Architects and Marine Engineering, "propellers derive the propulsive thrust by accelerating the fluid in which they work". The term "marine screw propeller" as used herein includes any rotating device which develops thrust relative to the axis of rotation by accelerating the fluid in which it works.

Thrust derived from a marine screw propeller in accordance with my invention provides the 'weight on bit' necessary for earth boring. This thrust may also provide the force required to advance a conduit, preferably neutrally buoyant in the drilling fluid, through which drilling fluids and energy needed for the boring operation are supplied.

In accordance with the present invention the shaft or shafts upon which the propeller or propellers are mounted are caused to rotate by an electric motor. The electric motor may be either an alternating or a direct current motor. Either the field or the armature or both of the motor may rotate and be fixed to a hollow rotating shaft. In the simplest form of my invention where a single shaft is employed and rotated by the motor, the drilling bit will be fixed to the forward end of the shaft. Where a plurality of shafts are employed, the bit will be fixed to the forward end of the innermost and longest shaft which usually, though not necessarily, will carry a marine screw propeller to generate additional thrust.

The shaft to which the bit is attached is hollow to allow the passage of drilling fluid therethrough to the bit for discharge therefrom. The drilling fluid serves to cool the bit and remove cuttings from the newly formed bore hole. The amount of drilling fluid circulated should be sufficient to discharge the functions of bit cooling and cutting removal but not so great as to significantly inhibit bit advance. However, the reaction force of the ejected fluid will be great enough to push the bit backward if rotation, and hence thrust, ceases. Where bit and propeller or propellers are mounted on a single shaft, the bit is self non-stalling, since as the bit tends to stall forward thrust rapidly approaches zero and the reactive forces of the discharged drilling fluid retract the bit. In cases where the thrust generating propeller is on a different shaft than the bit, the rotation of the bit may be monitored from the surface and, should the bit stall, the flow of power to the motor may be adjusted to reduce or terminate propeller rotation and to allow the reactive forces generated by the discharging drilling fluid to retract the bit.

Since the drilling system of my invention is primarily intended for use in drilling substantially horizontal holes, the conduit for conducting drilling fluid and electric power to the motor and bit combination is so constructed as to be flexible and capable of conforming to the curvatures of the well bore. On the other hand it must have sufficient resistance to twisting so that it will resist and substantially prevent free rotation of the motor housing. The use of a neutrally buoyant drilling system is taught and claimed in my copending application Ser. No. 304,098, filed Sept. 21, 1981. The term "neutrally buoyant" as used herein means that the density of a mass immersed in the drilling fluid is from 70 to 130 percent of the density of the fluid.

In the simplest form of my invention the thrust generating propeller and the drilling bit are mounted on a single hollow shaft extending from the forward end of the motor housing and driven by the rotor, usually the armature, of the electric motor. The stator, usually the field, is fixed to the motor housing to which the flexible conduit is fixedly connected. The conduit conducts the drilling fluid to the motor housing from whence it flows through the hollow rotating shaft to the drilling bit and is discharged through suitable ports therein. Any specific type of motor may be employed, either alternating or direct current. A series field, direct current motor may be used, since there is no danger that the load would be removed from the motor under working conditions. A shunt field or a compound field direct current motor may also be used. Generally, a polyphase alternating current induction motor is preferred.

To increase the vailable thrust, particularly where drilling in hard formations, it will generally be desirable to have the propeller rotate at a greater speed than the bit or to have a plurality of thrust generating propellers. More than one propeller may, of course, be placed on a single shaft. Where increased thrust is to be obtained by having the propeller rotate at a higher speed than the rotation speed of the drill bit, coaxial shafts projecting from the forward end of the motor housing would be employed. The drill bit would be connected to the forward end of the longer shaft.

In situations where both shafts are driven by the electric motor separate rotors might be employed to drive each of the shafts. By appropriate design of the number of poles or commutator segments the ratio of the speeds of the two shafts may be selected. A propeller may be placed on the inner bit-carrying shaft so that much or all of the thrust required for the drilling action may be generated on the inner shaft, with the thrust generated by the outer-shaft propeller available for advancing the motor housing and conduit. Where a plurality of propellers are used on coaxial shafts, counter rotation of the propellers and hence of the shafts will generate thrust more effectively. The type of motor disclosed in U.S. Pat. No. 2,462,182 where both field and armature rotate in opposite directions with each driving counter rotating coaxial shafts may also be employed. Counter rotation of propellers and shafts in addition to effectively generating thrust will also impose a minimum net amount of rotative torque forces on the housing. This, in turn, minimizes the twist resistance that must be withstood by the conduit.

In lateral boring operations the power required may be divided into two parts: first, the power needed to rotate the drilling tool, and second, the power needed to generate the advancing force, or thrust, required to cause the system to move forward which, of course, includes the "weight on bit" necessary to achieve penetration. Studies of rotary drilling practice show that relatively little power is required at the bit to rotate it, usually in the range of from a few horsepower up to one hundred or more depending upon the diameter of the hole, the kind of bit, the type of formation being drilled, the weight on the bit or forward thrust and the speed of rotation. In normal drilling practice the weight on bit, which results from the mass of drill collars used, may vary from a thousand pounds up to fifty thousand pounds or more. To translate weight on bit, a static gravity force, into horsepower, marine practice shows that bollard pull of a tugboat amounts to 15 to 40 or more pounds per shaft horsepower. Using a figure of 30 pounds of thrust per horsepower, 300 horsepower would deliver a penetrating force of 9,000 pounds (weight on bit) on the bit. Rotative power required could be of the order of 10 horsepower. The ratio of dynamic, advancing thrust to rotative power in this example is 30. This ratio may vary as noted above. In consideration of the above factors it has been found that the ratio of dynamic thrust horsepower to rotative horsepower may vary from as low as one to 220. Additionally, since the dynamic thrust must not only provide the equivalent of weight on bit but also the force for advancing the drilling system through the horizontal portion of the well bore, the ratio is usually greater than one. Speeds of propeller rotation in excess of the speed of bit rotation are especially useful for attaining the higher ratios of dynamic thrust horsepower to rotative horsepower. The more easily penetrated, softer formations would utilize the lower ratios while the harder formations would require the higher ratios.

It is desirable and generally feasible to utilize gravity forces to furnish at least some portion of the thrust required to advance the conduit, the motor and to provide weight on bit. Each thousand pounds of gravity force from the weight of drill pipe and any drill collars which can be transmitted to the system in the horizontal portion of the well bore would save from about 25 to 70 shaft horsepower. The amount of gravity thrust at the bit is limited, of course, by the resistance of the conduit to deformation in compression. The stiffness of the conduit and hence its ability to transmit forward thrust is governed by the flexibility required to enable it to pass through the minimum radius of curvature in the bore hole. The tubular conduit comprising short metallic pipe joints interconnected by unions capable of unidirectional misalignment described and claimed in my copending application Ser. No. 265,997, filed May 21, 1981, will traverse well bores having a radius of curvature as small as thirty feet and will have sufficient stiffness to transmit substantial advancing force to the system. Other flexible conduits with appropriate reinforcement will transmit useful advancing force, particularly where the minimum radius of curvature to be encountered is one hundred feet or more.

In drilling ordinary earth formations using conventional drilling bit, the bit rotation speed is preferably of the order of from 40 to 400 r.p.m. To obtain optimum thrust is such situations, the propeller or propellers preferably should rotate at considerably higher speeds. In such situations a plurality of shafts are required with the outer shaft or shafts rotating at the higher speeds. Any marine screw propeller on the innermost shaft of course would rotate at the same speed as the bit. In the discussion of specific embodiments of my invention hereinafter, various systems for obtaining different speeds of shaft rotation are described in an illustrative, not a limiting, sense.

BRIEF DESCRIPTION OF THE DRAWINGS

In the various figures of the drawings, like parts are designated by like reference characters.

DESCRIPTION OF PREFERRED EMBODIMENTS

Figure 1:
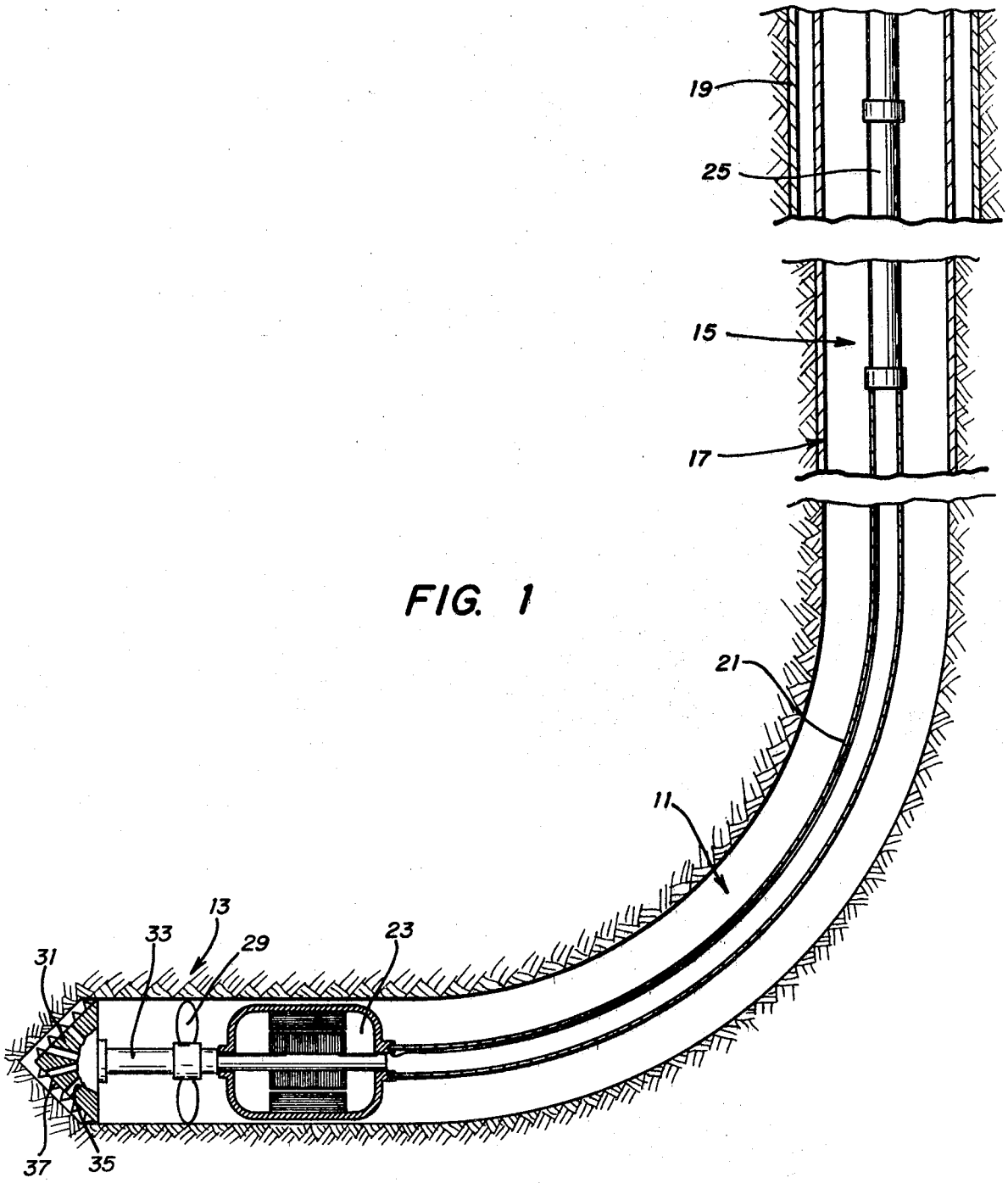
FIG. 1 shows a form of electric motor driven propeller bit, partly in cross section and partly schematic, in position for drilling a horizontal extension of a deviated well bore.

One form of electrically powered thrust generator and boring tool is shown in FIG. 1. The tool is shown in position to drill a horizontal extension of well bore 11 in earth formation 13. As shown well bore 11 is deviated from vertical portion 15, which may be drilled in the conventional manner and, as shown, is provided with the usual casing 17, generally throughout its vertical depth, and an upper surface casing 19.

Figure 2:
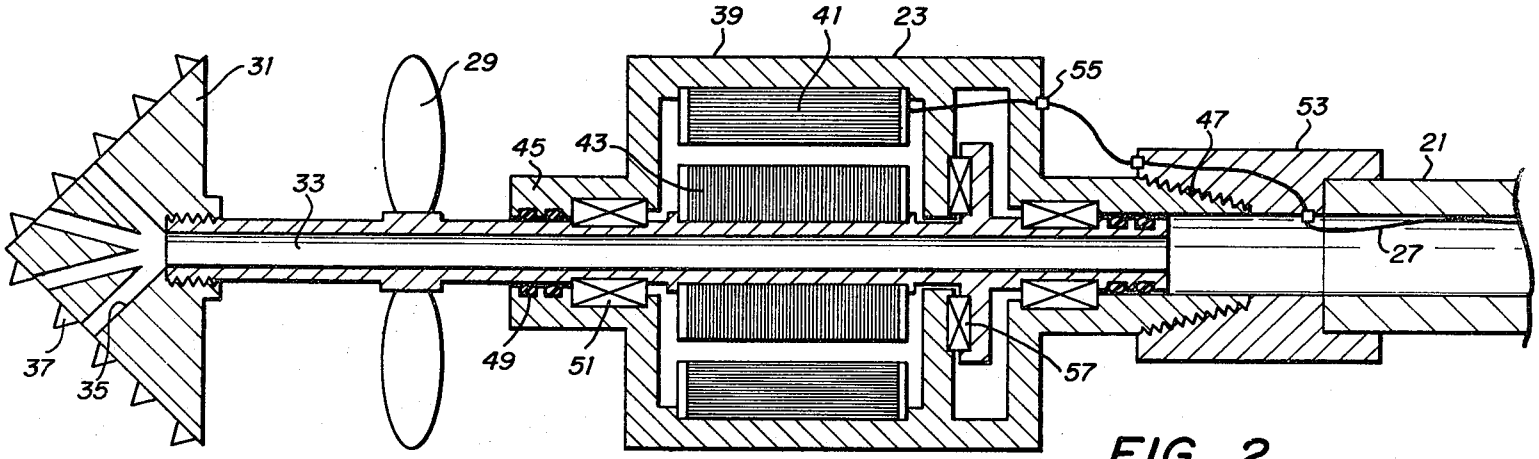
FIG. 2 is an enlarged view of the motor, propeller and drill bit of FIG. 1 showing details of the hollow motor shaft and the mounting of the bit and propeller thereon.

Flexible conduit 21 provides communication between the surface and the electric motor, generally indicated by the numeral 23, for the transmission of drilling fluid and electric power. Conduit 21 must have flexibility to conform to the curved well bore, must withstand the pressure differential between the drilling fluid within its and the returns on the outside, and must be resistant to twisting. It is also desirable that it be neutrally buoyant in the drilling fluid circulating in the well bore so that it is essentially weightless and its advance offers minimum impedance to the thrust generated by the motor-driven propeller as described hereinafter. A polyolefin such as polyethylene or other plastic material, such as epoxy resins or polyamides, reinforced with glass, steel or carbon fibers may be used. Flexible conduit 21 need not extend all the way to the surface but rather it may be connected to the lower end of conventional drill pipe 25 and lowered into the well bore using a conventional drilling rig, not shown. The drill pipe and the conduit are provided internally with electrical conductors 27, as shown in Fig. 2, for the transmission of electric power from the surface to motor 23. In operation motor 23 rotates propeller 29 and drill bit 31 which are mounted on the forward end of hollow shaft 33. Hollow motor shaft 33 transmits the drilling fluid from conduit 21 through motor 23 to bit 31 from whence it exists via ports 35. Bit 31 is shown as being provided with hardened abrasive inserts 37, such as tungsten carbide or polycrystaline diamonds to facilitate the drilling action, especially in hard earth formations.

FIG. 2 shows in more detail the arrangement of the components that comprise the drilling system of FIG. 1 of my invention. The electric motor comprises a housing 39 which encloses the field or stator 41 of the motor and within which the armature or rotor 43 is affixed to and rotates shaft 33 in operation. Annular extensions at the forward end 45 and rear end 47 of the housing serve as journal boxes for the hollow shaft 33. Rotary seals 49 and bearings 51 permit the shaft to rotate freely while preventing drilling fluid introduced through conduit 21 and surrounding the motor housing from entering the motor housing. Rear housing extension 47 is externally threaded to receive internally threaded female coupling 53 fixed to the end of conduit 21. Thus, conduit 21 will resist the tendency of the stator and motor housing to rotate in a direction counter to the rotation of shaft 33 as a torque load is imposed through the action of the drill bit and the propeller. Electrical conductor 27 which is carried by conduit 21 passes through coupling 53 and is connected to the motor by means of fluid-proof connectors 55. Thrust bearings 57 transmit the forward thrust of propeller 29 to housing 39 which, in turn, transmits a pulling force on conduit 21 via coupling 53.

In the form of my invention shown in FIGS. 1 and 2 the drilling bit and propeller rotate at the same speed. The forward thrust generated by rotation of the marine screw propeller provides weight on bit and via thrust bearing 57 provides the necessary forward thrust to advance the motor and conduit as drilling progresses.

Figure 3:
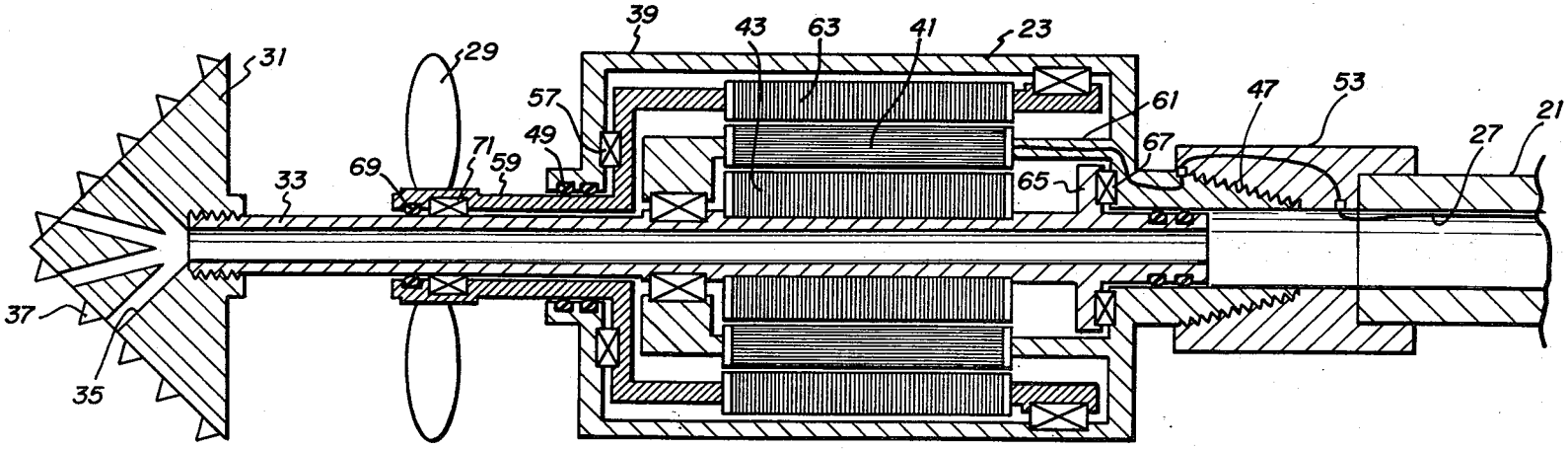
FIG. 3 shows an alternative form of motor, propeller and bit combination wherein two coaxial motor driven shafts are employed with the propeller mounted on the outer shaft.

In the form of my invention shown in FIG. 3 two concentric hollow shafts driven by electric motor 23 are employed. The drill bit 31 is fixed to the forward end of longer, inner shaft 33 and the marine screw propeller 29 fixed to outer shaft 59. The field or stator 41 of the motor instead of being fixed to the outer shell of the motor housing as in FIG. 2 is carried by an internal, annular ring 61, integral with the housing and so spaced as to receive an inner annular armature or rotor 43 and an outer annular armature or rotor 63. Rotor 43 is carried by shaft 33 and rotor 63 by outer shaft 59.

Forward thrust generated by rotation of propeller 29 is transmitted by outer shaft 59 via thrust bearing 57 to housing 39. In this case, however, the forward thrust must not only advance the housing and conduit as drilling progresses but also must be transmitted to the rotating inner shaft to provide the necessary weight on bit. To transmit this thrust, shaft 33 is provided with collar 65 and the requisite force applied via thrust bearings 67.

To prevent leakage of drilling fluid into the annulus between the two hollow shafts and into the motor, rotary seal 69 is provided. Bearings 71 near the forward end of the outer shafts serve to maintain proper clearance between the rotating shafts.

In the form of my invention shown in FIG. 3, the propeller may be rotated at a much higher rate of speed than the bit. Such relationship is frequently desirable to obtain increased thrust as discussed above.

Figure 4:
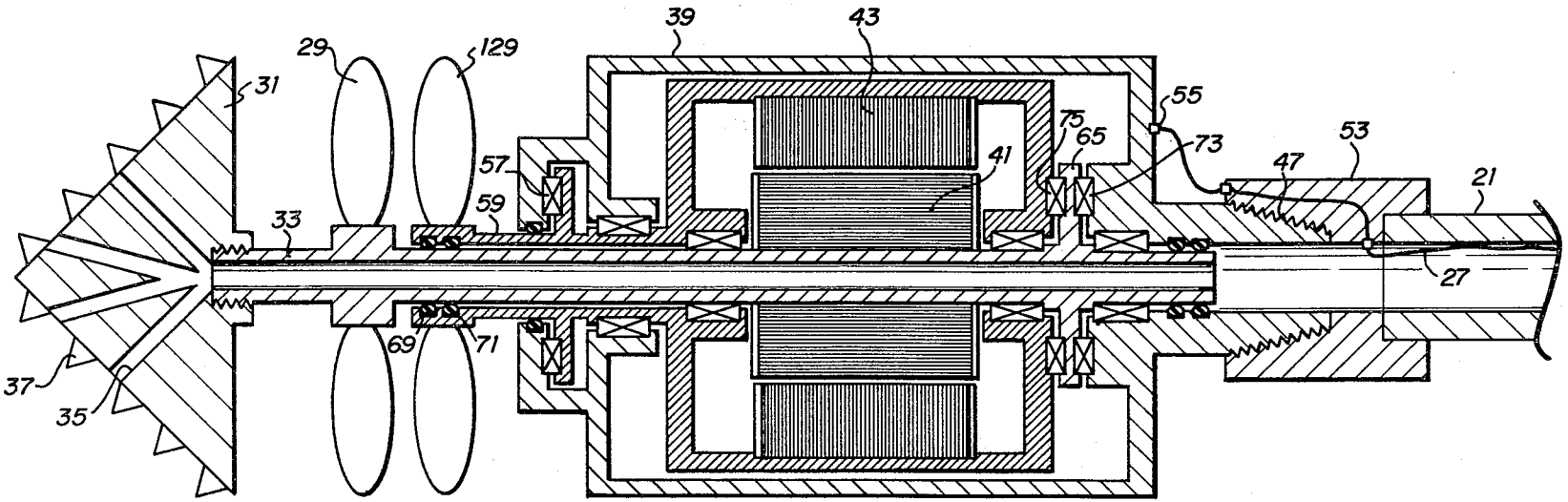
FIG. 4 shows still another form of motor, propeller and bit combination employing two co-axial motor driven shafts wherein the motor field is affixed to one shaft, the armature to the other shaft and the two shafts rotate in opposite directions.
Figure 2:
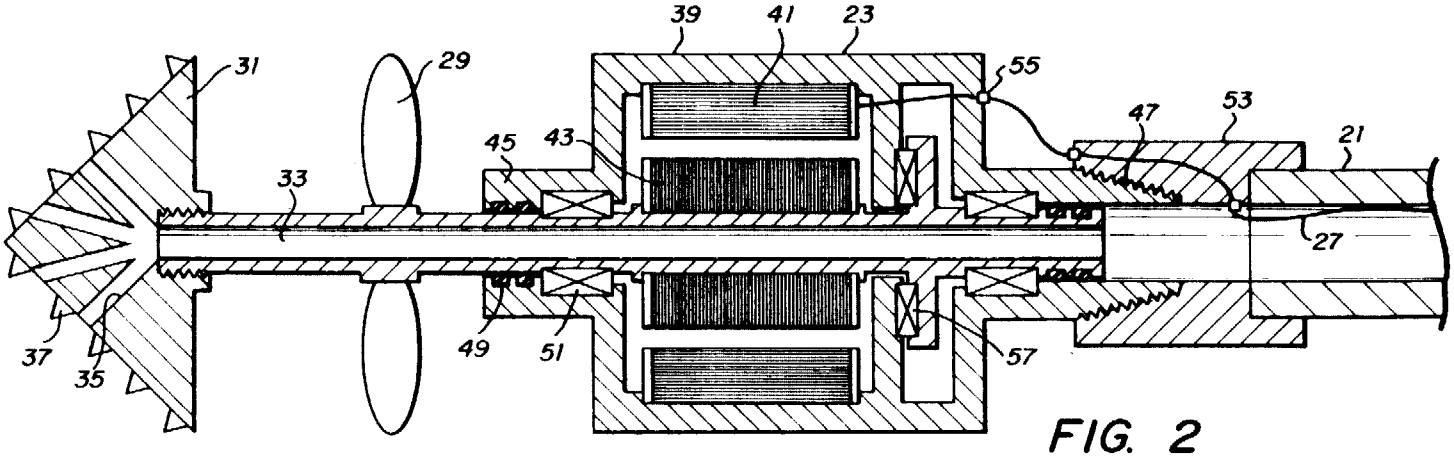
Figure 3:
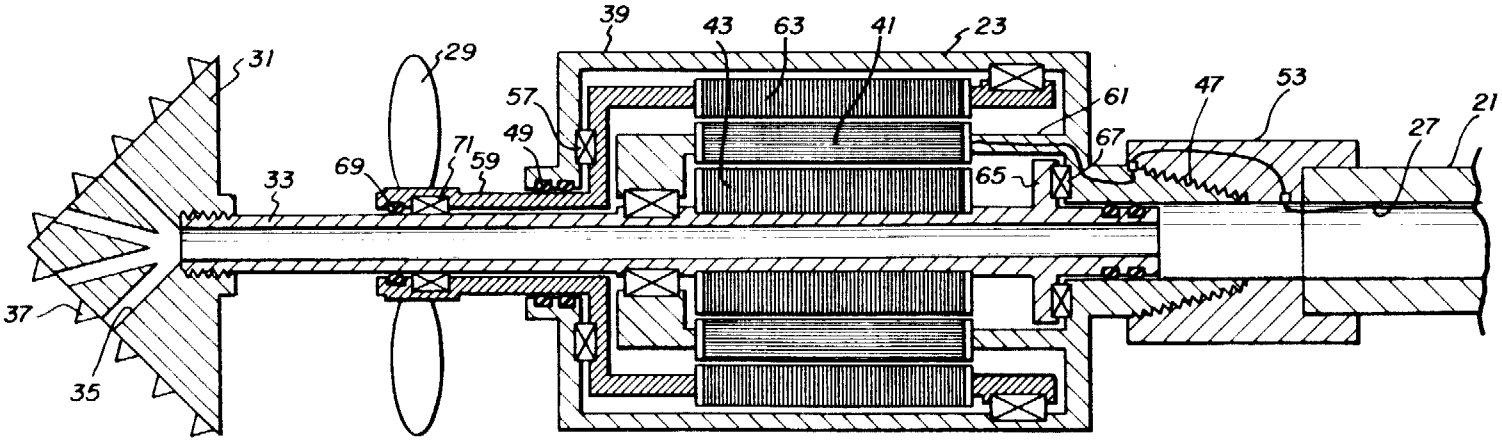

Another form of my invention employing concentric hollow rotating shafts is shown in FIG. 4. In this embodiment the field 41 of the motor is fixed to one shaft and the armature 43 to the other. Both field and armature are free to rotate within the outer casing 39 of the motor housing. The field and the armature will rotate in opposite directions and hence inner shaft 33 and outer shaft 59 will likewise rotate in opposite directions. The absolute speed of rotation of field and armature will be dependent upon the load imposed upon shafts 33 and 59. Since it is usually desirable that more horsepower be utilized for generating thrust than for rotating the bit, it is desirable that each shaft carry a propeller. As shown propeller 29 is mounted on shaft 33 and propeller 129 on shaft 59 with rotary seal 69 preventing leakage of drilling fluid into the annulus between the shafts and bearings 71 maintaining alignment. Since shaft 33 and shaft 59 will rotate in opposite directions and since it is desired that the rotation of each generate forward thrust, the pitch of the blades on the two propellers will necessarily be opposite in direction.

As mentioned previously one form of motor wherein both field and armature rotate in opposite directions is disclosed in U.S. Pat. No. 2,462,182 to D. A. Guerdan et al assigned to Westinghouse Electric Corporation.

Forward thrust generated by the rotation of propeller 129 is transmitted to housing 39 via thrust bearing 57 for advancing the housing and conduit and will be available to supplement the thrust generated by propeller 29 to provide additional weight on the bit 31. The relative amounts of forward thrust generated by propellers 29 and 129 will be dependent upon the absolute speed of rotation of each, which in turn will depend upon the load imposed restraining rotation of each shaft. Because of variations in the load imposed on the drill bit and turbulence of the fluids in which the propellers are operating, the relationship between the thrust generated by each will vary. In view of this, collar 65 on inner shaft 59 is suitably recessed to receive thrust bearings 73 for receiving thrust from housing 39 and thrust bearings 75 for transmitting thrust to outer shaft 59 and hence to housing 39.

Several advantages are obtained by using the embodiment of FIG. 4. Counter rotation of the propellers, particularly where closely spaced, results in more efficient generation of forward thrust. Also, importantly, counter rotation of the motor parts and shafts, which are linked to the motor housing only via rotating seals and bearings, results in the transmittal of minimal rotative torque to the housing and hence to the conduit. This, in turn, reduces the amount of twist resistance that must be built into the conduit.

Figure 5:
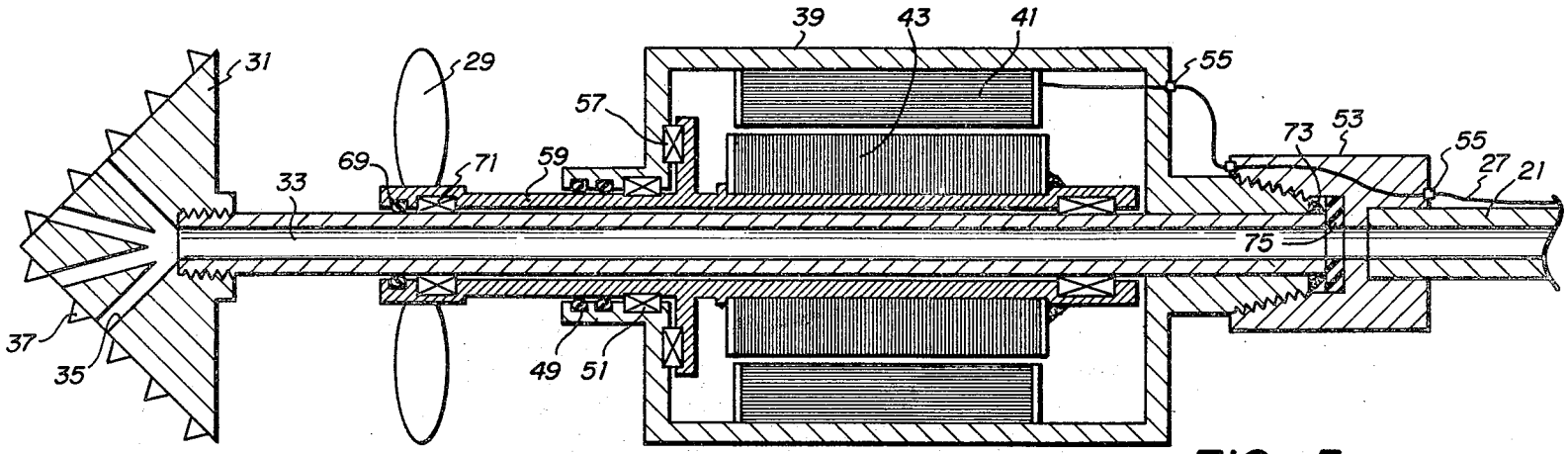
FIG. 5 shows a form of my invention wherein both the inner shaft and the housing are fixedly connected to a rotating flexible conduit carrying the drilling fluid and electric power and the rotor or the motor drives the outer shaft carrying the propeller in a direction counter to the direction of rotation of the conduit and inner shaft.

A form of my invention wherein the electric motor is used only to provide the forward thrust for the system is disclosed in FIG. 5. In this embodiment the conduit 21 is rotated at the speed at which it is desired to rotate shaft 33 and bit 31. Referring back to FIG. 1, the drill pipe 25 may be rotated from the surface by the rotary table on a conventional drilling rig. This, in turn, will rotate conduit 21. In this form the conduit is fixedly connected not only to motor housing 39 but also to shaft 33 and bit 31 will rotate with the conduit. As shown, the end of shaft 33 extends slightly beyond the rear end of motor housing 39 and is welded 73 thereto. Rear housing extension is externally threaded to receive internally threaded female coupling 53 and fixed to the end of conduit 21. Sealing rubber ring 75 may be inserted between the mating faces of coupling 53 and the end of the shaft. Electrical conductor 27, shown as carried externally of conduit 21, is connected to connector 55 on the coupling and thence through the coupling to a connector 55 on the motor housing.

The field or stator 41 of the electric motor is fixed to the housing and rotates with it. Rotor armature 43 is fixed to the outer concentric shaft which carries propeller 29, rotation of which generates the necessary forward thrust to provide weight on bit and to advance the system. As in the embodiments shown in FIGS. 3 and 4, thrust bearings 57 transmit the forward thrust to the housing, inner shaft and bit and conduit. The embodiment of FIG. 5 is particularly suitable where the drilling characteristics are such that a high weight on bit is desired along with a relatively low speed of bit rotation.

Since many modifications and possible embodiments and uses may be made of the apparatus of this invention without departing from the scope thereof, it is to be understood that all matter herein set forth or shown is to be interpreted as illustrative not as limiting.

I claim:

1. A rotary drilling system for drilling a well bore in the earth comprising in combination:
   a. an electric motor comprising a housing and at least one rotor;
   b. a twist resistant flexible conduit for conducting drilling fluid and electric power to one end of said housing of said electric motor;
   c. at least one rotor driven hollow shaft projecting from the other end of said housing;
   d. hollow shaft driven bit means;
   e. marine screw propeller means mounted on said rotor driven shaft rotation of which generates forward thrust along the axis of said shaft;
   f. means for transmitting the forward thrust generated by said propeller to said bit means, said housing and said conduit; and
   g. coupling means connecting the end of said conduit and said motor housing, said coupling means transmitting torque from the motor housing to the conduit to resist the tendency of the motor housing to rotate in a direction counter to the rotation of said hollow shaft as torque is imposed to the housing through the action of the drill bit and the propeller.

2. The drilling system of claim 1 in which there is a single rotor driven hollow shaft projecting from said housing and in which the propeller means and the bit means are both mounted on said shaft.

3. The rotary drilling system of claim 1 in which there are two concentric rotor driven hollow shafts the inner of which extends beyond the outer hollow shaft and the bit means are mounted at the end of the inner hollow shaft and the propeller means are fixed to the outer hollow shaft.

4. The rotary drilling system of claim 1 in which there are two concentric hollow shafts projecting from the other end of the housing, the inner of which extends beyond the outer and the bit means are mounted on the end thereof, and the outer shaft is driven by the rotor and has propeller means fixed thereon.

5. A rotary drilling system for drilling a well bore in the earth comprising in combination:
   a. an electric motor comprising a housing, a stator affixed to said housing, and a rotor;
   b. rigid coupling means secured to one end of the housing;
   c. a twist resistant flexible conduit connected to the coupling means secured to one end of the housing to said electric motor for conducting drilling fluid and electric power thereto, said coupling means transmitting torque from the motor housing to the conduit to resist the tendency of the stator and motor housing to rotate relative to the conduit upon operation of said rotor;
   d. a hollow shaft projecting from the other end of said housing, said rotor being affixed to said hollow shaft;
   e. bit means affixed to the forward end of said hollow shaft;

f. marine screw propeller means mounted on said hollow shaft for generating forward thrust along the axis of said shaft; and g. means for transmitting forward thrust from said shaft to said housing.

6. A rotary drilling system for drilling a well bore in the earth comprising in combination:

a. an electric motor comprising a housing, a stator affixed to said housing, and a rotor;

b. a twist resistant rotatable flexible conduit fixedly connected to one end of the housing of said electric motor for conducting drilling fluid and electric power thereto;

c. a pair of concentric hollow shafts projecting from the other end of said housing the inner of which projects beyond the outer shaft and drilling bit means affixed to the forward projecting end thereof;

d. means for connecting said rotor to said outer hollow shaft;

e. marine screw propeller means mounted on said outer hollow shaft for generating forward thrust along the axis of said shaft;

f. means for transmitting forward thrust from said outer shaft to said housing and said inner shaft; and g. means for interconnecting the rear end of said inner shaft and said conduit for the passage of drilling fluid therethrough to said bit means.

7. A rotary drilling system for drilling a well bore in the earth comprising in combination:

a. a pair of concentric hollow shafts, the inner of which projects at one end beyond the outer and has drilling bit means affixed to the projecting end thereof;

b. a housing supporting said shafts in axial alignment and surrounding at least a portion thereof;

c. a twist resistant flexible conduit adapted to conduct drilling fluid and power fixedly connected to said housing and in fluid communication with the inner hollow shaft;

d. marine screw propeller means mounted on the outer hollow shaft in a manner such that rotation of said propeller means generates thrust in a direction toward the bit carrying end of the inner shaft;

e. means for transforming power carried by said conduit to a force causing said outer shaft to rotate; and f. means for transmitting the thrust in said outer shaft generated by rotation of said propeller means to said housing, said inner shaft and said conduit.

8. The drilling system of claim 7 in which means are provided adjacent the extremities of the outer shaft for preventing the ingress of fluids into the annular space between the shafts.

9. A rotary drilling system for drilling a well bore in the earth comprising in combination:

a. a rotary boring tool affixed to the end of a hollow shaft;

b. an electric motor comprising a housing and a rotor;

c. a twist resistant flexible conduit fixedly connected to one end of the housing of said electric motor for conducting drilling fluid and electric power thereto;

d. marine screw propeller means for generating thrust connected to said rotor;

e. means for conducting drilling fluid from said conduit to said hollow shaft;

f. means for transmitting the forward thrust generated by said propeller means to said housing and said hollow shaft; and g. coupling means connecting the end of said conduit and said motor housing, said coupling means transmitting reactive torque from the motor housing to the conduit to prevent relative rotation therebetween to resist the tendency of the motor housing to rotate in a direction counter to the rotation of said shaft when torque is imposed on the motor housing by the action of the rotary tool and the propeller.

10. A rotary drilling system for drilling a well bore in the earth comprising in combination:

a. inner and outer concentric hollow shafts the inner shaft projects at one end beyond the end of the outer shaft;

b. drilling bit means affixed to the projecting end of the inner shaft;

c. marine screw propeller means, rotation of which generates thrust along the axis of said shafts in a direction toward said drilling bit means, mounted on said outer shaft;

d. a housing supporting said shafts in axial alignment;

e. a twist resistant flexible conduit;

f. a rigid hollow coupling securing said housing relative to said conduit for transmitting torque between said housing and said conduit, said coupling being adapted to conduit drilling fluid and power to said housing and in fluid communication with the inner hollow shaft;

g. means for converting the power conducted by said conduit into a force causing rotation of said outer shaft and propeller means and rotation of said inner shaft and bit means; and h. means for transmitting the thrust generated by said propeller means to said housing and said inner shaft.

11. The drilling system of claim 10 in which the means actuated by the power conducted by the conduit cause the outer shaft to rotate at a higher speed than the inner shaft.

12. A system for drilling a substantially horizontal well bore in the earth utilizing a rotating drilling bit and circulating drilling fluid for cooling said drilling bit and for returning earth cuttings comprising in combination:

a. an electric motor comprising a housing, a stator affixed to said housing, and a rotor;

b. a twist resistant flexible conduit substantially neutrally buoyant in said drilling fluid;

c. a hollow shaft extending through said housing and projecting from the other end thereof, said rotor being affixed to said hollow shaft;

d. said drilling bit affixed to the projecting end of said hollow shaft;

e. means for confining the flow of drilling fluid conducted by said conduit to the interior of said hollow shaft for discharge from said drilling bit;

f. marine screw propeller means mounted on said hollow shaft for generating forward thrust along the axis of said shaft;

g. means for transmitting said thrust from said shaft to said housing; and h. hollow coupling means for conducting drilling fluid and power secured between the housing of said electric motor and said conduit, said coupling means limiting rotation of the housing of said electric motor relative to said conduit whereby torque is transferred between said motor and conduit.

13. A system for drilling a well bore in the earth comprising:

a. an electric motor comprising a rotor affixed to and adapted to rotate a shaft and a housing;

b. a single connection to said housing from the surface of the earth comprising a twist resistant flexible conduit connected to one end of the housing of said electric motor for conducting drilling fluid and electric power thereto;

c. a hollow shaft extending through said housing and projecting from the other end thereof, said hollow shaft having drilling bit means mounted on the projecting end thereof;

d. means for confining the flow of drilling fluid conducted by said conduit to the interior of said hollow shaft for discharge from said drilling bit;

e. marine screw propeller means mounted on said rotor driven shaft rotation of which generates thrust in the direction of said drilling bit; and f. means for transmitting the forward thrust generated by rotation of said propeller to said bit means, said housing and said conduit, said conduit being adapted to limit rotation of said housing relative to the motor housing whereby torque is transmitted between said housing and said conduit.

14. A rotary drilling system for drilling a well bore in the earth comprising in combination:

a. an electric motor comprising a housing and at least one rotor;

b. a twist resistant flexible conduit fixedly connected to one end of the housing of said electric motor for conducting drilling fluid and electric power thereto;

c. inner and outer concentric rotor driven hollow shafts, the inner shaft extending beyond the outer shaft;

d. hollow shaft driven bit means mounted on the end of the inner hollow shaft;

e. marine screw propeller means mounted on said outer hollow rotor driven shaft, rotation of said propeller means generating forward thrust along the axis of said shaft; and f. means for transmitting the forward thrust generated by said propeller means to said bit means, said housing and said conduit.

15. A rotary drilling system for drilling a well bore in the earth comprising in combination:

a. an electric motor comprising a housing and at least one rotor;

b. a twist resistant flexible conduit fixedly connected to one end of the housing of said electric motor for conducting drilling fluid and electric power thereto;

c. inner and outer concentric hollow shafts projecting from the other end of the housing, the inner shaft extending beyond the end of outer shaft, the outer shaft being driven by the rotor;

d. hollow shaft driven bit means mounted on the end of the outer shaft;

e. marine screw propeller means mounted on said outer rotor driven shaft, rotation of said propeller generating forward thrust along the axis of said shaft; and f. means for transmitting the forward thrust generated by said propeller means to said bit means, said housing and said conduit.

* * * * *

UNITED STATES PATENT AND TRADEMARK OFFICE

CERTIFICATE OF CORRECTION

PATENT NO. : 4,436,168

DATED : March 13, 1984

INVENTOR(S) : Newton B, Dismukes

It is certified that error appears in the above-identified patent and that said Letters Patent is hereby corrected as shown below:

Sheet 2 of the Drawing consisting of Fig. 2, should be deleted to be replaced with Sheet 2 of 3, consisting of Figs. 2 and 3 as shown on the attached sheet but will apply to the Grant only.

Signed and Sealed this

*Eighteenth* Day of *September 1984*

[SEAL]

*Attest:*

GERALD J. MOSSINGHOFF

*Attesting Officer*

*Commissioner of Patents and Trademarks*